US011517088B1

(12) United States Patent
Carratura

(10) Patent No.: US 11,517,088 B1
(45) Date of Patent: Dec. 6, 2022

(54) SOFT GOGGLE CASE WITH ONE-HANDED QUICK RELEASE

(71) Applicant: Ralph S. Carratura, Allison Park, PA (US)

(72) Inventor: Ralph S. Carratura, Allison Park, PA (US)

( * ) Notice: Subject to any disclaimer, the term of this patent is extended or adjusted under 35 U.S.C. 154(b) by 54 days.

(21) Appl. No.: 17/370,893

(22) Filed: Jul. 8, 2021

(51) Int. Cl.

| | |
|---|---|
| ***A45C 11/04*** | (2006.01) |
| ***A45C 13/06*** | (2006.01) |
| ***A45F 5/02*** | (2006.01) |
| ***A45C 13/30*** | (2006.01) |

(52) U.S. Cl.
CPC ..... *A45C 11/04* (2013.01); *A45C 13/06* (2013.01); *A45C 13/30* (2013.01); *A45F 5/021* (2013.01); *A45F 2200/0541* (2013.01)

(58) Field of Classification Search
CPC .. A45C 11/04; A45C 13/06; A45F 2200/0541
USPC ..... 206/5, 6
See application file for complete search history.

(56) References Cited

U.S. PATENT DOCUMENTS

| | | | | |
|---|---|---|---|---|
| 4,270,590 | A * | 6/1981 | Marshall | A45C 5/00 190/100 |
| 5,501,321 | A * | 3/1996 | Liu | A45C 11/04 206/5 |
| 5,833,053 | A * | 11/1998 | Wood | A45C 13/021 206/5 |
| 2001/0004053 | A1* | 6/2001 | Taormina | A45C 11/043 206/581 |

* cited by examiner

*Primary Examiner* — Anthony D Stashick
*Assistant Examiner* — Symren K Sanghera
(74) *Attorney, Agent, or Firm* — Karen Tang-Wai Sutton

(57) ABSTRACT

A four-way stretch fabric case for storing a pair of goggles, the case having a hinged internal frame positioned inside a body portion and a cover portion. The internal frame is comprised of a cover frame sized and shaped to hingeably cover the body and further formed with a coupling point, a vertical leg and an open to load hinge affixed to both the cover frame and the vertical leg. A spring loaded release mechanism affixed to a lower end of the vertical leg is comprised of a post with a spring at its upper end and a hook at its lower end, with a release cord affixed to its lower end. The hook is adapted to disengage the coupling point by pulling the cord and moving the hook to allow the cover to hinge open.

19 Claims, 12 Drawing Sheets

SOFT GOGGLE CASE WITH ONE-HANDED QUICK RELEASE

CROSS-REFERENCE TO RELATED APPLICATIONS

NA

STATEMENT REGARDING FEDERALLY SPONSORED RESEARCH OR DEVELOPMENT

NA

NAMES OF THE PARTIES TO A JOINT RESEARCH AGREEMENT

NA

INCORPORATION BY REFERENCE OF MATERIAL SUBMITTED ON A COMPACT DISC OR AS A TEXT FILE VIA THE EFS WEB SYSTEM

NA

STATEMENT REGARDING PRIOR DISCLOSURES BY THE INVENTOR OR A JOINT INVENTOR

NA

BACKGROUND OF THE INVENTION

Field of the Invention

The present invention pertains to the field of soft cases for storing goggles. Specifically, the invention is a soft goggle case with a loaded to open spring hinged case cover with a quick, one-handed release mechanism.

Background Art

Off-road racing describes a variety of racing sports such as dirt bike, quad and UTV racing, the most familiar being motocross or MX in its abbreviated form. This exciting sport features off-road, closed circuit courses that includes obstacles, hills, jumps and other challenging terrain, and of course, the track is dirt and subject to the elements. Consequently, riders get splattered with mud, dust, and debris while racing. Most riders wear goggles to protect their vision during the race, but dirty goggles lead to poor visibility. Some riders will use tear offs, which are relatively thin, plastic transparent covers that fit over special goggles fitted with tear off posts, where the rider will simply remove and discard the outermost tear off to reveal a clean lower tear off covering the goggle lens area. Other riders will use a roll off system to control visibility. Roll offs are disposable lenses that are packaged in a canister, much like 35 mm film cases, which attach to the goggles. To advance the lens film, there is a pull cord that you pull to advance the film across your goggle lens. A roll holds around 25 advances.

With only so many tear offs or roll offs advances available for the rider to use, most riders will need to use a second pair of clean goggles and simply swap out the dirty pair for the clean pair. The problem with the clean pair is that the standard protective case for goggles is a fabric, drawstring bag that works well in clean conditions such as skiing, but is tricky to use in a dirty, dusty sport such as motocross, as reaching into the bag can put unwanted dust and dirt onto the goggles or introduce dust and debris into the bag. There is no easy or fast way to remove goggles stored inside a drawstring bag either, particularly when trying to be careful to avoid adding dust or fingerprints to the lens area. In other cases, where the rider has a support team, sometimes clean goggles are worn on hats to keep them readily accessible, but this subjects them to dust, water, etc. and they are often given a cleaning with a rag prior to switching out the rider's dirty goggles for the clean ones. For a rider, there is no easy way to carry a second clean pair of goggles that is quickly and cleanly accessible when riding even in non-race conditions. The drawstring bag is currently the only solution for goggle storage and transport.

What is needed is a carrying case for goggles that protects the goggles from debris, can be quickly and easily opened with one hand, and allows the goggles to be removed quickly and cleanly from the case. What is also needed is a carrying case for goggles that is removably mounted in a variety of applications, such as on a wall or a waistband, to allow convenient storage options.

DISCLOSURE OF INVENTION

A case for storing a pair of safety goggles having a lens area and a bridge, the case comprising a four-way stretch fabric case having a body and a cover, an internal frame secured to the body and to the cover, a release mechanism attached to the internal frame, and a first mating member attached to the internal frame and adapted to removably mate with a second mating member. The body is comprised of a front side, a back side, and an exterior back side, the front side further formed with an access opening in a center of the front side to create a pair of opposed front side walls in spaced apart relationship and a goggle receiving space between the front side and the back side. The body is sized and shaped to receive the pair of safety goggles and the cover is sized and shaped to hingeably cover the body. The internal frame is further comprised of a T-shaped frame and a lens-shaped cover frame pivotably affixed to the T-shaped frame, wherein the T-shaped frame is further comprised of an open to load hinge having an upper leaf and a lower leaf, and a vertical leg having a proximal end, a distal end and a length between the proximal and distal ends, the proximal end of the vertical leg affixed to the lower leaf, and the vertical leg positioned inside the goggle receiving space. The cover frame may include a telescopically adjustable arm length in some embodiments, and is comprised of a wire-like flexible metal, plastic, or other suitable material sufficiently rigid to maintain the lens-shape and the coupling point when the fabric case stretches to accommodate the pair of safety goggles stored inside the body with the cover secured thereto. The cover is secured to the cover frame and the vertical leg is secured to the back of the body and may be removably or permanently affixed thereto. The cover frame is further comprised of a coupling point formed below the bridge of the pair of safety goggles when the pair of safety goggles is stored inside the body, and the release mechanism is further comprised of a hook adapted to slideably disengage the coupling point such that when the release mechanism is engaged, the hook slides and releases the coupling point, allowing the cover to rotate into an open position.

In yet another aspect of the invention, the case further features a cover latch having a fixed end and a moving end, the fixed end positioned adjacent the hinge and the moving end pivotably positionable to be at least one of perpendicular to or parallel with the upper leaf, whereby positioning the cover latch perpendicular to the upper leaf positions the cover in a semi-open position and positioning the cover latch parallel to the upper leaf positions the cover in a fully-open position.

In still yet another aspect of the invention, the release mechanism is further comprised of a post with a hook is affixed to a distal end of the post. The post and hook are in slideable relationship with the length of the vertical leg. In some embodiments, the release mechanism is further comprised of an outer tube with which the post is in telescoping relationship, the tube being affixed to the vertical leg and the post slideably positioned inside the tube. A wire spring is affixed to a proximal end of the post opposite the hook end, with a spring stop affixed to the vertical leg above the wire spring to limit the upwards vertical travel of the post along the vertical leg.

The release mechanism is further comprised of a pull cord affixed to at least one of the post and the hook, and wherein pulling the pull cord tensions the spring and moves the hook away from the access opening and releasing the pull cord allows the spring to move into an untensioned state and moves the hook towards the access opening.

In yet another aspect of the invention, the second mating member is affixed to at least one of a handle, waistband, armband, handlebar, table, clip, pop-up tent leg and wall mount and the second mating member is at least one of a universal clip, strap, or mount, wherein the universal clip, strap or mount has a standardized mating structure coupling with the first mating member.

In still yet another aspect of the invention, the first mating member and the second mating member are comprised of at least one of hook and loop closures, side release clips, and male-female couplers.

In still yet another aspect of the invention, in one embodiment, the first mating member is a hook and the second mating member is a member sized and shaped to receive the hook.

In still yet another aspect of the invention, the access opening in the front side is a V-shaped opening with the vertical member positioned in a center of the V-shaped opening and its distal end protruding beyond the goggle-receiving space to position the hook below the body and the below the lowermost point of the v-shape.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
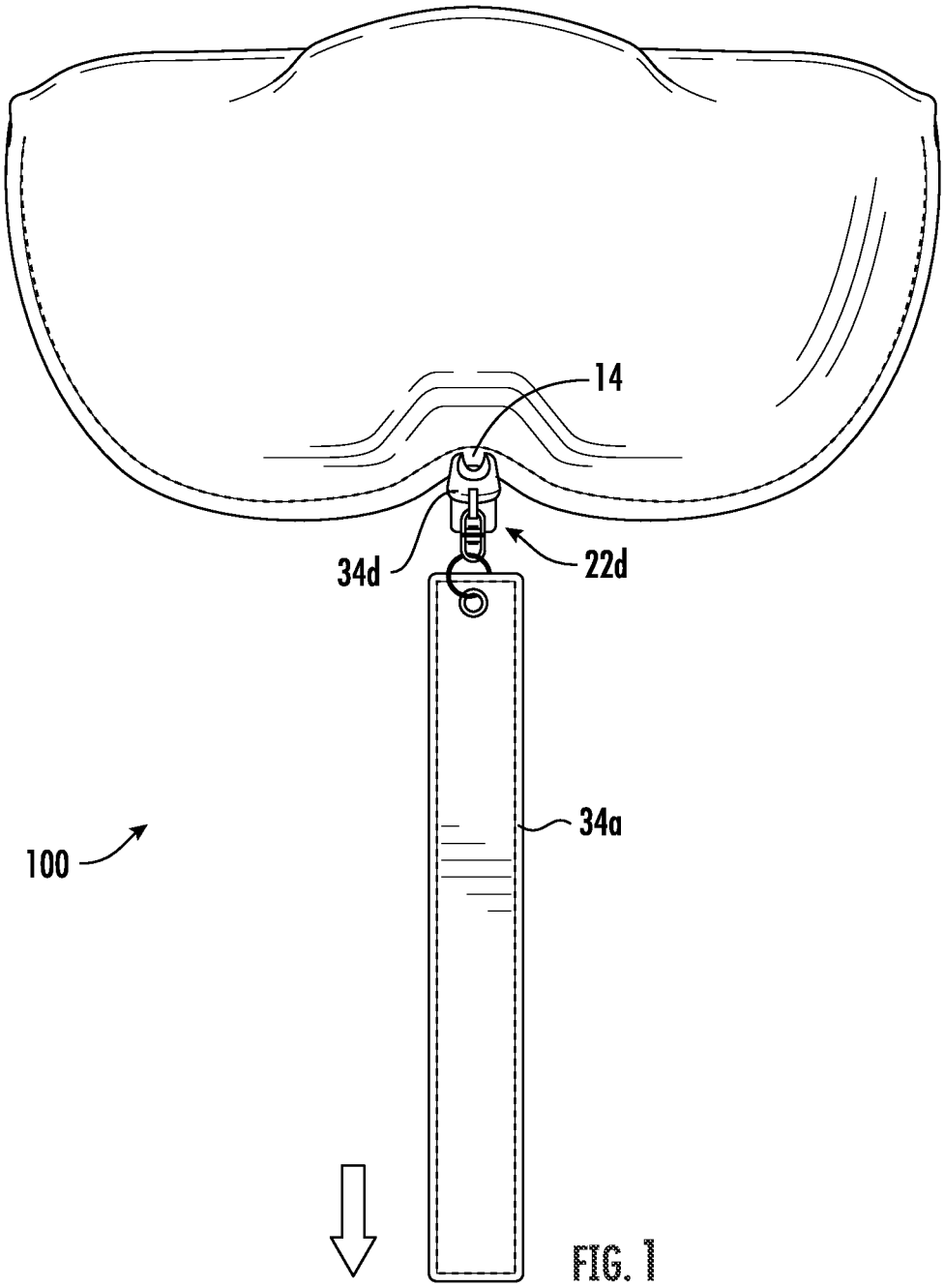
FIG. 1 is a front elevation view of a case with a quick release mechanism, shown with a cover of the case in a closed position and with a pair of safety goggles stored inside the case.

The following is a list of reference labels used in the drawings to label components of different embodiments of the invention, and the names of the indicated components.

100 case
10 cover
12 cover frame
12' substitute cover frame
12*a* frame arm
12*b* arm end
12*c* desiccant pocket
14 coupling point
16 open to load spring hinge
16*ab* upper leaf knuckle
16*ac* lower leaf knuckle
16*b* upper leaf
16*c* lower leaf
16*d* spring
16*e* arm receiver
18 T-frame
22 vertical leg
22*a* uppermost end or proximal end of vertical leg
22*d* lowermost end or distal end of vertical
24 first aperture
26 cover latch
30 handle
32 second mounting bracket
32*a* second mating member
32*b* armband or waistband
34 quick release mechanism
34*a* pull cord release
34*b* wire spring
34*c* post
34*d* hook
34*e* second aperture
34*f* tube
34*g* post top end
34*h* post bottom end
36 fabric portion
36*a* hook and loop mating fastener
36*b* elastic
36*c* access hole
38 first fastener
40 second fastener or spring stop
42 first mounting bracket
42*a* first mating member
44 goggles or pair of goggles

44*a* bridge of goggles
44*b* frame or top frame of goggles (brow adjacent)
44*c* viewing area or lens area of goggles
50 V-shaped opening or access
52 case body or body
54 case back or back
56 case front or front
58 case interior area or goggle-receiving space
60 goggle drawstring bag (PRIOR ART)

DETAILED DESCRIPTION

A soft goggle case with one-handed quick cover release or case according to the invention 100 is shown in FIGS. 1 to 10. The case 100 is comprised of an internal frame portion 12 16 18 and a fabric portion 36.

Figure 2:
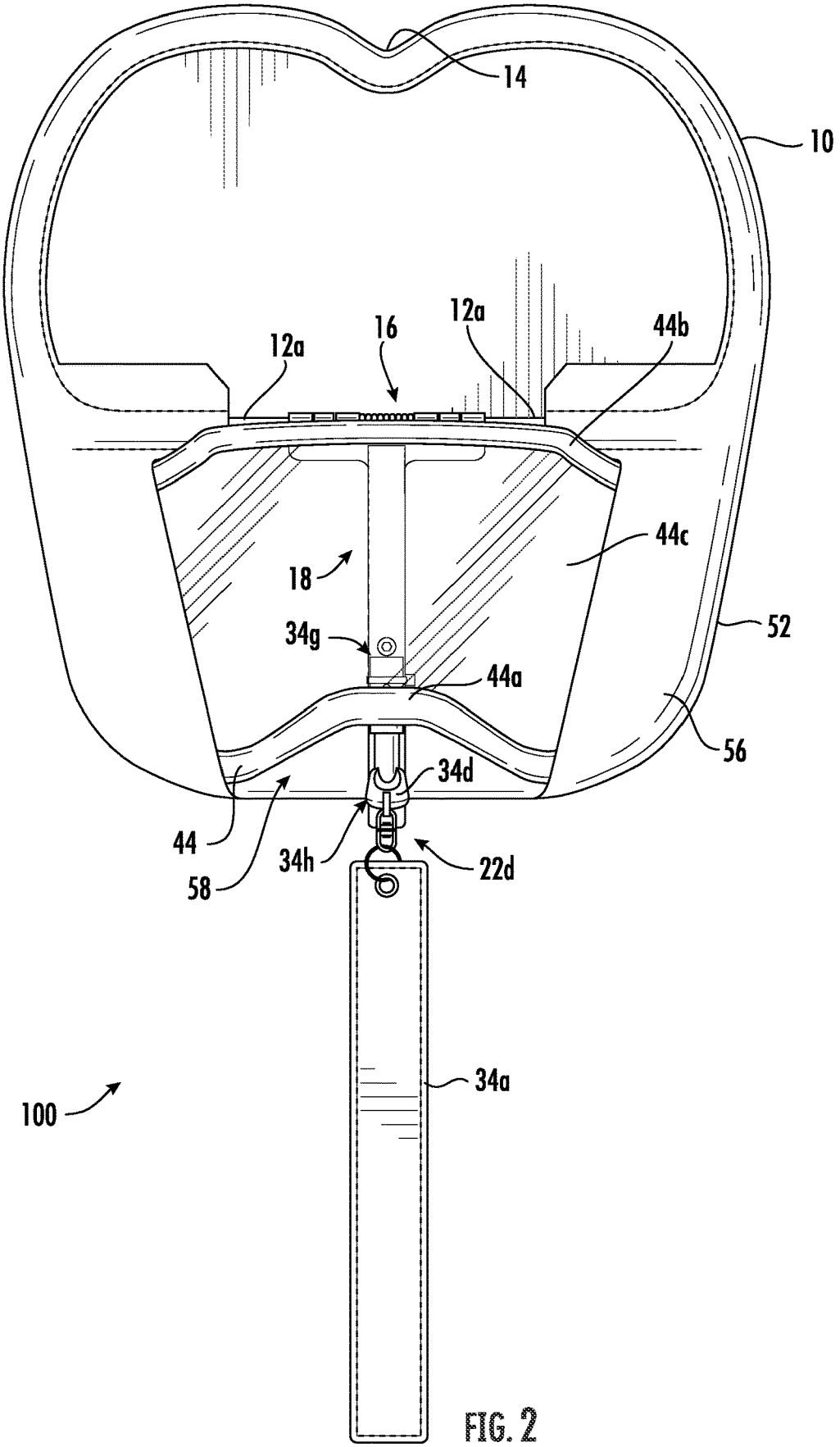
FIG. 2 is a front elevation view of the case in FIG. 1, shown with the cover in an open position.
Figure 3A:
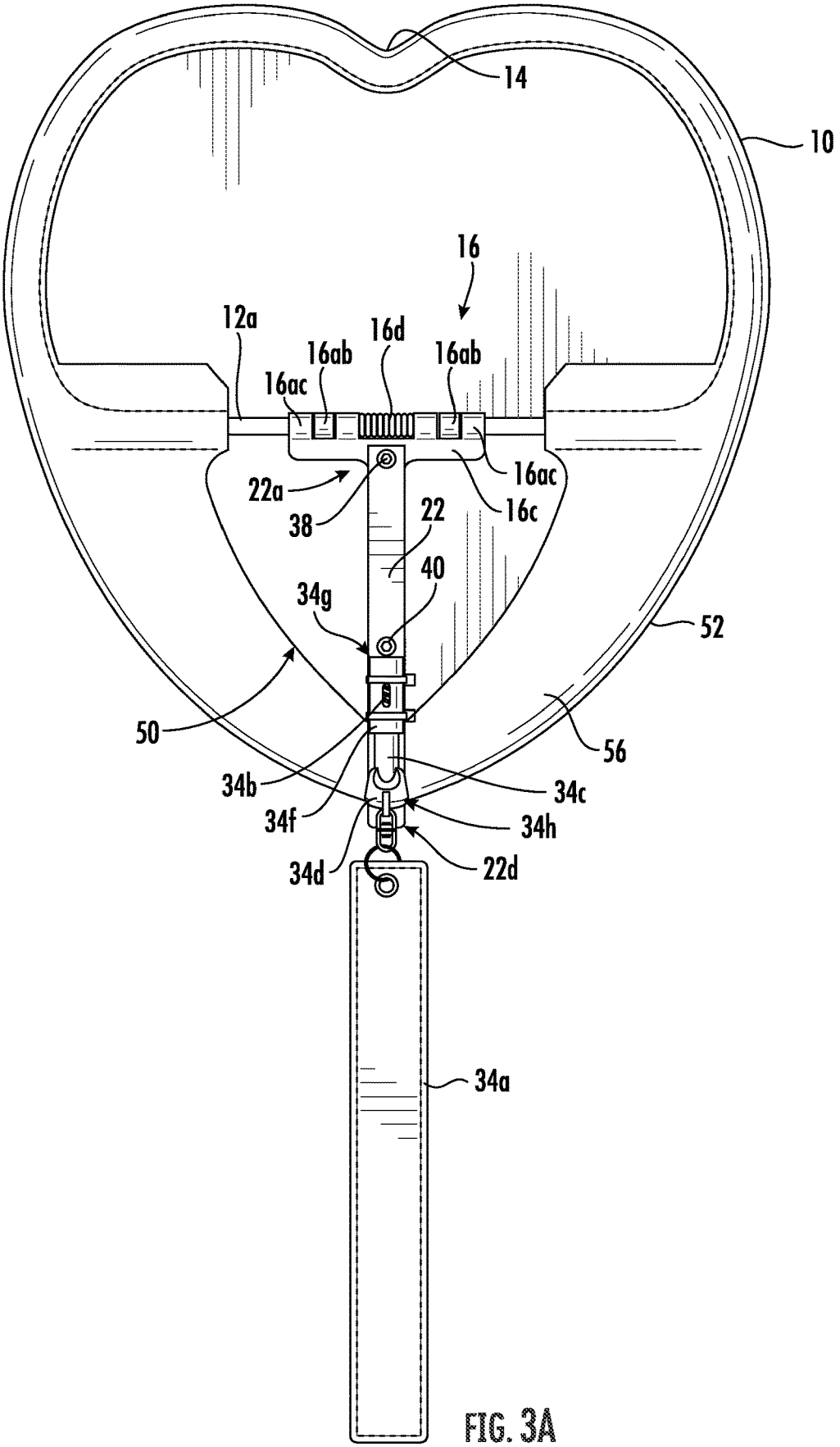
FIG. 3A is a front elevation view of the case in FIG. 2, shown with the pair of safety goggles removed from the case.
Figure 3B:
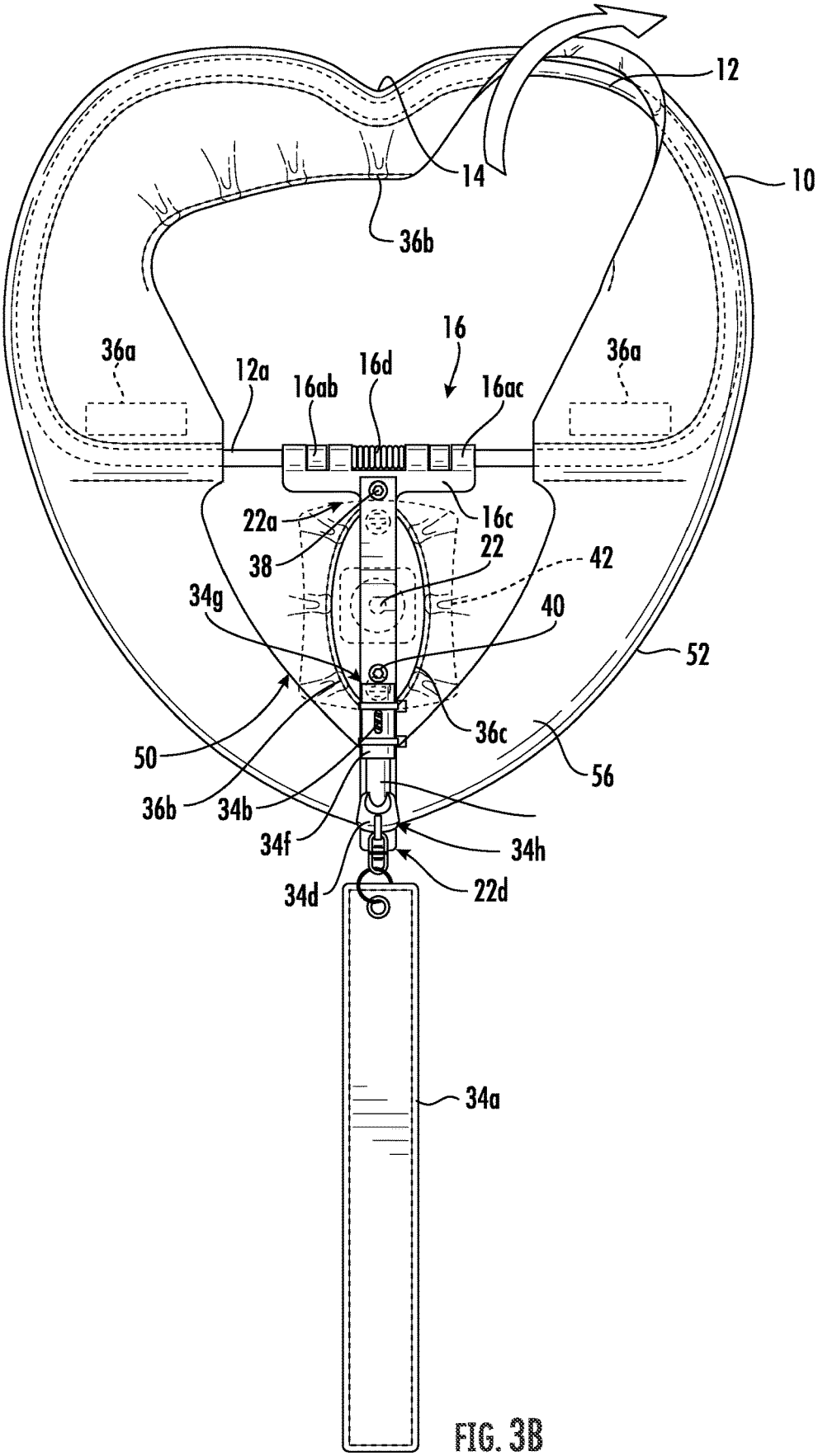
FIG. 3B is a front elevation view of a first embodiment of the case in FIG. 3A, shown with a removable fabric portion.

The frame portion is comprised of a T-shaped frame 18 and a cover frame 12. The T-shaped frame has a vertical leg 22 affixed to be perpendicular to a horizontal hinge 16. The hinge 16 is further comprised of an upper leaf 16*b*, an opposed lower leaf 16*c*, a knuckle 16*ab* 16*ac* on each of the upper and lower leaves 16*b* 16*c* and spring 16*d* in linear alignment with the knuckles 16*ab* 16*ac*. In FIGS. 2-3B, the upper leaf 16*b* is minimized to be an approximately same width as the frame arms 12*a*, and in FIGS. 5A-C and 7, the upper leaf 16*b* is shown with a wider, more prominent width that is used in conjunction with a cover latch 26 shown in FIG. 7. In all the embodiments shown in the Figures, the hinge 16 is an open to load spring hinge, with the knuckles 16*ab* 16*ac* oriented to face a front or goggle access side of the case 100 when the spring 16*d* is in an untensioned state. When the spring 16*d* is in a tensioned state, the knuckles 16*ab* 16*ac* are inside the case 100 and the upper leaf 16*b* is adjacent the lower leaf 16*c*. The vertical leg 22 is affixed to the lower leaf 16*c* of the hinge 16, and in some embodiments, the vertical leg 22, lower leaf 16*c* and its knuckle 16*ac* are in fact a single piece of metal, structural plastic or other suitably strong but lightweight material adapted to receive a hinge pin (not shown) and thus pivotably couple the upper leaf 16*b* to the lower leaf 16*c*.

Figure 5A:
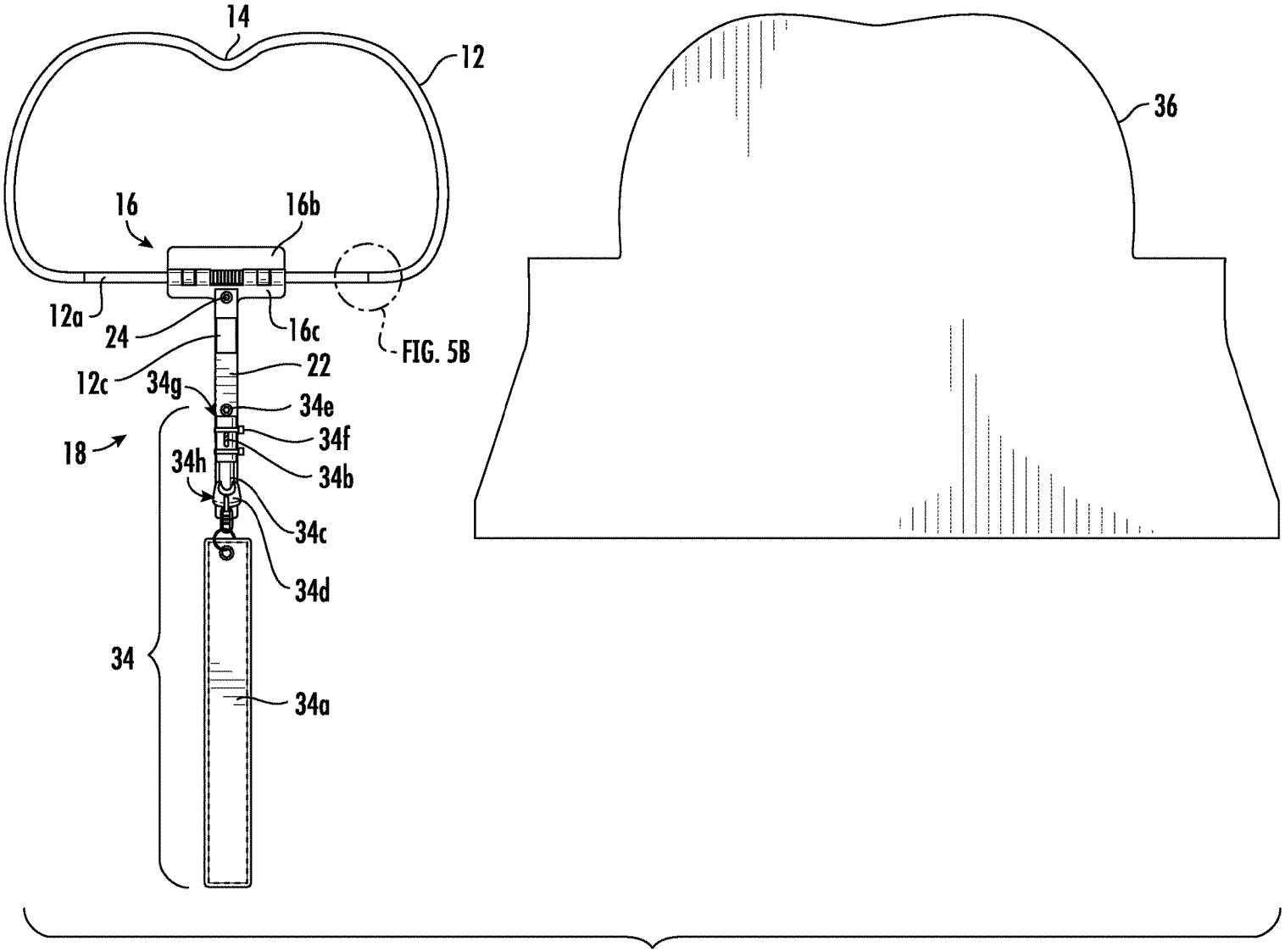
FIG. 5A is a partial exploded view of the case, showing a frame portion and the fabric portion of the case according to the invention.
Figure 5B:
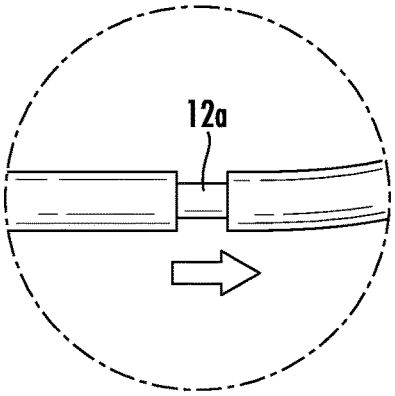
FIG. 5B is a detail view of a frame arm in FIG. 5A, showing an adjustable frame arm embodiment.
Figure 5C:
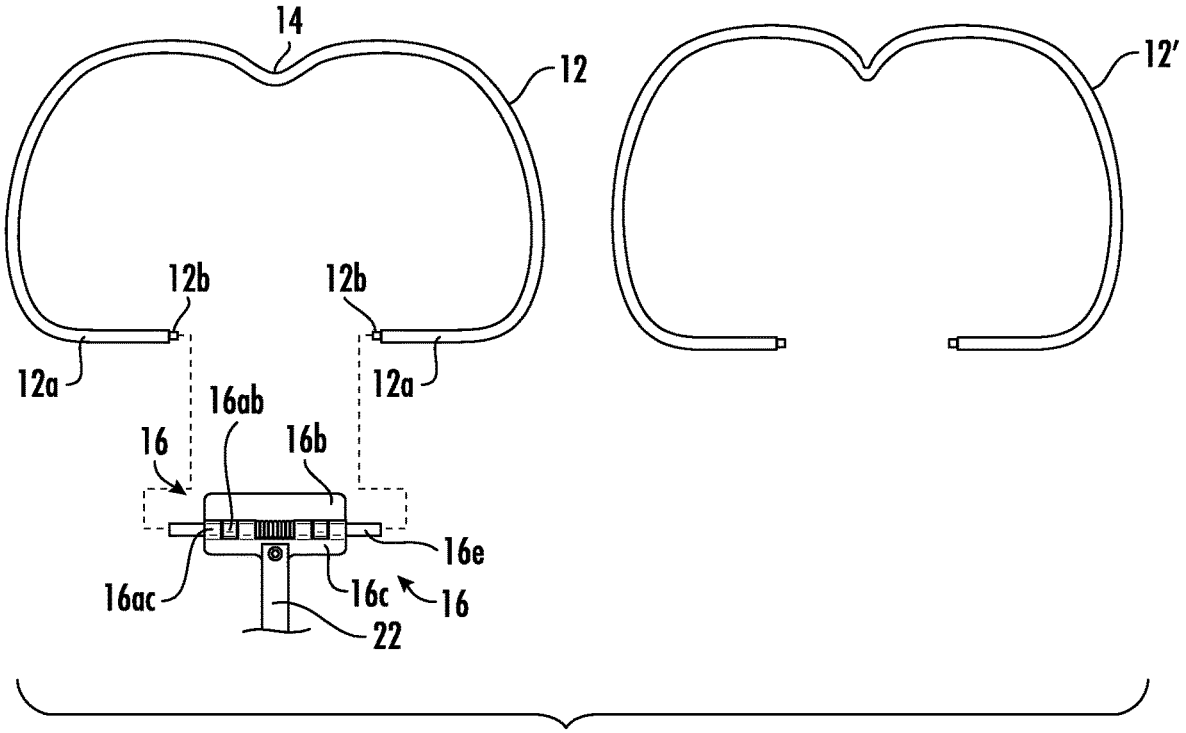
FIG. 5C is a front view of a replaceable frame arm embodiment of the frame portion of the case according to the invention.

The upper leaf 16*b* is removably or permanently affixed to the cover frame 12, which is a curved frame formed from a single piece of wire, plastic or other flexible but strong material shaped so as to approximate an overall perimeter shape of a viewing or lens area 44*c* of a pair of goggles 44, where the frame 12 has a pair of semi circles separated by a coupling point 14, and a linear portion opposite the semi-circular portion forming a frame arm 12*a* and shaped to approximate a top frame 44*b* of the pair of goggles 44. The cover frame 12 is sufficiently flexible to bend and approximate a three dimensional shape of the lens area 44*c* of the pair of goggles 44 when the hinge 16 is in a closed position. The cover frame 12 is shaped such that a left side of the cover frame 12 is a mirror image of a right side of the cover frame 12 when divided vertically through the coupling point 14. The frame arm 12*a* may be a single arm or two arms, and in some embodiments, shown in FIGS. 5A-C a frame arm length may additionally or alternatively be telescopically adjustable to expand the cover 10 to accommodate larger sized goggles to optimize fit of the pair of goggles stored in the case 100. The frame arm 12*a* is removably or permanently affixed to the upper leaf 16*b* and in some embodiments, the frame 12, frame arms 12*a*, knuckle 16*ab* and the upper leaf 16*b* are in fact one integral piece joined to the lower leaf 16*c* and its knuckle 16*ac* by the pin, with the spring 16*d* inserted on the pin. For the embodiment where the cover frame 12 is removably secured, as shown in FIG. 5C, the frame arm 12*a* has a centralized gap, with a pair of opposed arm ends 12*b* that pressure fit into a pair of opposed arm receivers 16*e*. This embodiment allows a user to select an optimally sized cover frame 12 12' from a series of sized cover frames to accommodate different goggle brands, sizes and shapes. For the embodiment with the removable cover frame 12, the fabric portion 36 typically will be a removable portion as shown in FIG. 3B, where the fabric portion of the cover 10 has an elasticized perimeter or the fabric is sufficiently stretchable to allow the cover to be stretched over the cover frame 12.

The vertical leg 22 is configured as a flatten bar or strut, with an uppermost or proximal end 22*a* affixed to the lower leaf 16*c*. The vertical leg 22 is shown with a first aperture 24 positioned towards the proximal end 22*a* and a second aperture 34*e* in spaced apart relationship with the first aperture 24 positioned towards the distal end 22*d* of the vertical leg 22. In FIG. 5A, an optional desiccant pocket 12*c* for holding a desiccant bag (not shown) is shown positioned on the vertical leg 22 in the body 52 moisture control. The pocket 12*c* could alternatively hold a deodorizing packet, lip balm, mints or other small items and serves as an additional optional storage space.

The fabric portion 36 of the case 100 is a four-way stretch fabric configured as a goggle holder or case body or body 52 having a front 56, a back 54, and an interior area or goggle-receiving space 58, and a cover 10 sized and shaped to cover the front 56 and to be attached to the curved frame 12. In some embodiments, the fabric portion 36 is sewn or otherwise permanently secured to the cover frame 12, such as in FIG. 2, but in other embodiments, the fabric portion is removably secured to the cover frame 12 as shown in FIG. 3B. For removably secured embodiments of the fabric portion 36, hook and loop fasteners 36*a* are optionally used to secure the cover around the cover frame 12, and an interior perimeter of the cover 10 is either formed with an elastic 36*b* or the fabric itself is sufficiently stretchy to allow the cover 10 to be expanded and pulled over the cover frame 12.

The fabric portion 36 of the body 52 is similarly either permanently or removably secured to the T-frame 18. Fasteners 38 40, in the embodiment shown configured as threaded machine screws, are positioned through the back 54 of the body 52 and into the holes or apertures 24 34*e* of the vertical leg 22, securing the body 52 thereto. In other embodiments, the body 52 may be welded or otherwise adhered to the vertical leg 22. The body 52 is approximately rectangular, but can be any size and shape capable of receiving a pair of goggles 44, with a V-shaped cutaway or access 50 formed centrally in the front 56. When the pair of goggles 44 is store inside the body 52, both a nose bridge 44*a* and a top frame 44*b* of the goggles 44 is accessible through the V-shaped access 50, with a forehead adjacent, top frame 44*b* side of the goggles positioned to be parallel with the frame arm 12*a*. The goggle lens area 44*c* is at least partially secured by the fabric sides of the front 56 of the body 52. While the inventor believes four-way stretch fabric is ideally suited for the case fabric portion 36, any fabric or combination of materials that allows for either sufficient stretch or was crafted to be a perfect fit without any stretching properties can be used in place of the four-way stretch fabric described herein and is included by the term "four-way stretch fabric." A case made of two or more materials could incorporate four-way stretch material at the ends of the case, for instance, while the main front portion could be a non-stretch material such as denim, nylon, etc. Use of elastic 36*b* can also be incorporated into the fabric portion 36, particularly around the perimeter of the fabric portion to allow sufficient ease for embodiments where the frame portion and the fabric portion are separable.

For embodiments where the fabric portion 36 is permanently secured to the frame portion, inside the body 52, the T-frame 18 is affixed to an interior side of the back 54 by affixing the vertical leg portion 22 centrally to the back inner wall by securing the first fastener 38 though the back 54 and into the first aperture 24, and optionally, the spring stop 40 through the back 54 and into the second aperture 34*e*. An uppermost side of the body 52 and the cover 10 are affixed to the cover frame 12 and secured thereto. The fabric may be welded, sewn, glued or otherwise suitably affixed to the frame. For instance, in some embodiments (not shown), the fabric is attached to a bracket that then clips into the first mounting bracket 42. The hinge 16 is positioned at a mouth of the V-shaped access 50 and is optionally adhered to the fabric portion 36.

A quick-release mechanism 34 is positioned towards a distal end 22*d* of the vertical leg 22. The quick-release mechanism 34 is comprised of the second aperture 34*e*, the spring stop 40 secured into the second aperture 34*e*, a post 34*c* slideably housed inside a tube 34*f*, and a wire spring 34*b* mounted on a top end 34*g* of the post 34*c* and protected inside the tube 34*f* from rubbing or other contact, with the wire spring 34*b* resting against the spring stop 40 in the spring's untensioned state. A hook 34*d* configured to receive the coupling point 14 of the cover 10 and affixed to a bottom end 34*h* of the post 34*c*, is also attached to a pull cord 34*a* attached to the bottom end of the post 34*c*. The tube 34*f* is typically attached to the vertical leg 22 by gluing, welding, or strapping in place. In some embodiments, the tube 34*f* and vertical leg 22 may also be formed as a single piece.

To use the case 100, the frame arms 12*a* are adjusted to approximate a same width as the pair of goggles 44 to be stored, in embodiments where the cover frame 12 has an adjustable size (see FIGS. 5B-C) or is adjustable by substituting an appropriately sized cover frame 12 into the cover 10. The pull cord 34*a* is tugged downwards with sufficient force to cause the post 34*c* to slide downwards inside the tube 34*f* and tension the wire spring 34*b* of the quick release mechanism 34. The hook 34*d* moves downwards along with the pull cord 34*a*, releasing the coupling point 14 of the cover frame 12 from the hook 34*d*. Once the hook 34*d* releases the coupling point 14, the hinge 16 opens the cover 10 and positions it into an open position shown in FIGS. 2 and 3A-B. In an embodiment where the cover 10 has a fully open and semi-open position, shown in FIG. 7, a pivoting cover latch 26 having a fixed end and a moving end is pivoted such that the moving end is perpendicular to the upper leaf 16*b* of the hinge 16 and directly above the upper leaf 16*b*. When the cover latch 26 is in this position, releasing the coupling point 14 from the hook 34*d* causes the cover 10 to rotate 90 degrees, with the motion stopped by the cover latch 26 positioned to prevent further movement of the cover 10 by blocking the pivoting movement of the upper leaf 16*b*. The cover latch 26 can be affixed to either the vertical leg 22, to the first mounting member 42 or first mating member 42*a*, or to another structure affixed to these structures, but in any event must be positioned such that when the release mechanism 34 is engaged, the pivoted moving end of the cover latch 26 stops the motion of the cover 10 and thus the cover latch 26 does not necessarily need to be mounted centrally along the vertical leg 22 as shown in the embodiment in the Figures but rather just in a location where it will intercept the upper leaf 16*b* as it hinges open when the release mechanism 34 is engaged. When the latch 26 is positioned to be parallel to the hinge 16, the cover 10 can rotate 180 degrees into the fully open position. In either the semi or fully open positions, the pair of goggles can be positioned inside the body 52 by holding the goggles 44 in one hand over the V shaped access 50 and then pulling the sides of the body around the lens area 44*c* of the pair of goggles 44, oriented so that the frame arm 12*a* is adjacent a brow adjacent portion or top frame 44*b* of the goggles 44.

To close the case 100, the cover 10 is folded over the body 52 and secured to the hook 34*d* by pressure fitting the coupling point 14 into the hook 34*d*. The four-way stretch material of the cover 10 fits snuggly over the stored goggles 44, as does the body 52. To remove the goggles 44, the pull cord 34*a* is again pulled, unhooking the coupling point 14 from the hook 34*a*, and releasing the cover 10 by action of the open to load spring hinge. The goggles 44 are pulled out of the case body 52 by grabbing them at the bridge 44*a* and the top frame 44*b* of the goggles 44 and pulling them outwards from the body 52. The soft fabric sides of the body 52 easily release the goggles 44.

For the embodiment of the case where the fabric portion is non-removable, on the back 54 of the case 100 directly opposite the vertical leg 22, a first fastener 38 affixes the back 54 of the body 52 to the vertical leg 22 through the first aperture 24, and a second fastener 40 affixes the back 54 to the vertical leg through the second aperture 34*e*, where the second fastener or spring stop 40 serves a spring motion limiting stop. Using these same fasteners 38 40 and apertures 24 34*e*, a first mounting bracket 42 is affixed to the vertical leg 22 through the fabric portion of the back 54 where the first mounting bracket 42 sits on the back 54 of the body 52.

For the embodiment with the removable fabric portion, the first mounting bracket 42 affixes directly to a back side of the vertical leg 22 and the fabric portion 36 has a hole or access hole 36*c* that fits around the first mounting bracket 42, or some other structure affixed directly to the vertical leg 22, such as hooks or protruding buttons, etc. The first mounting bracket 42 provides some additional structure to the case 100. A first mating member 42*a* located on the first mounting bracket 42 is adapted to mate with a second mating member 32*a* positioned on a second mounting bracket 32.

Figure 4:
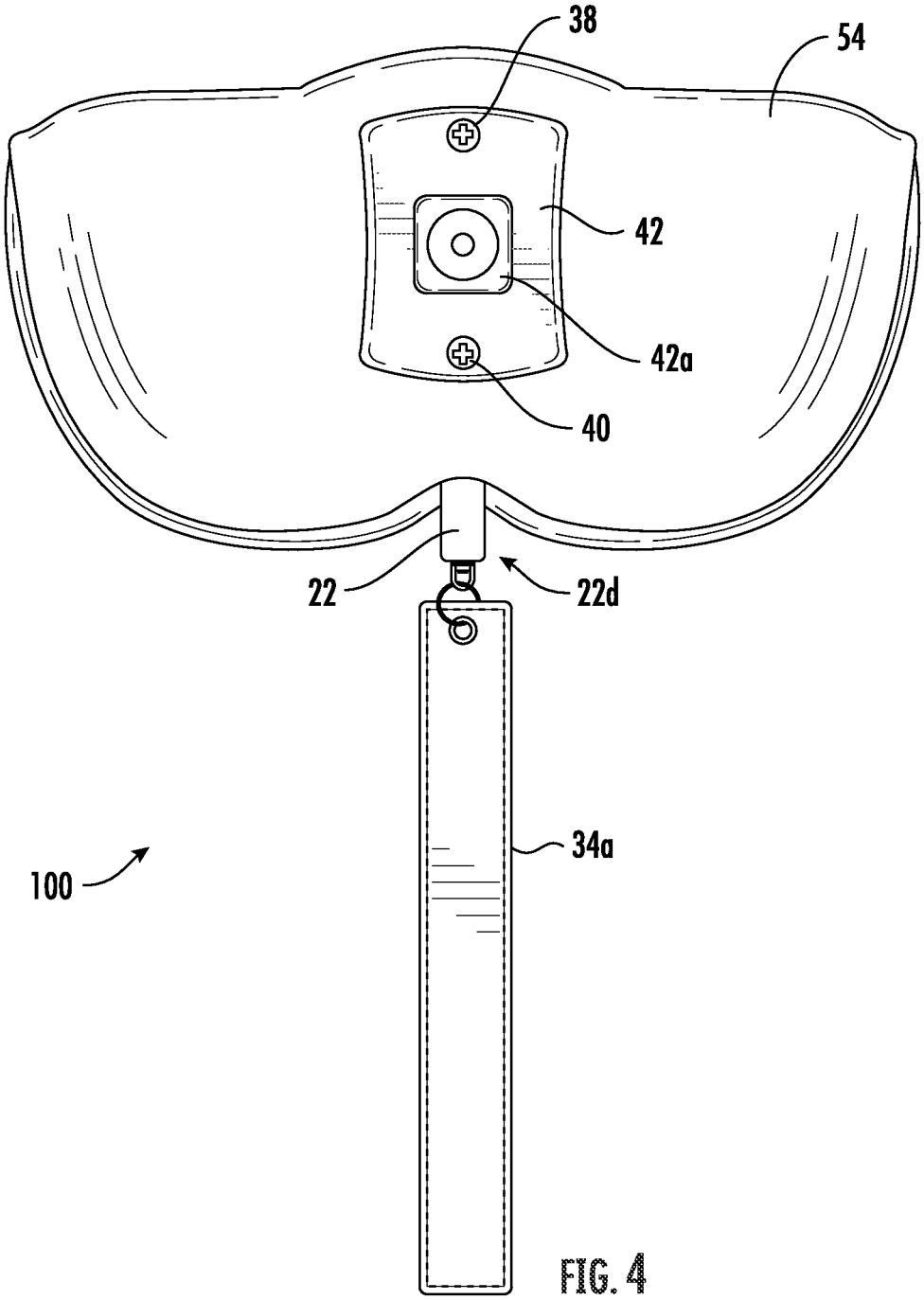
FIG. 4 is a back elevation view of the case in FIG. 1, shown with the pair of safety goggles stored inside the case.
Figure 6A:
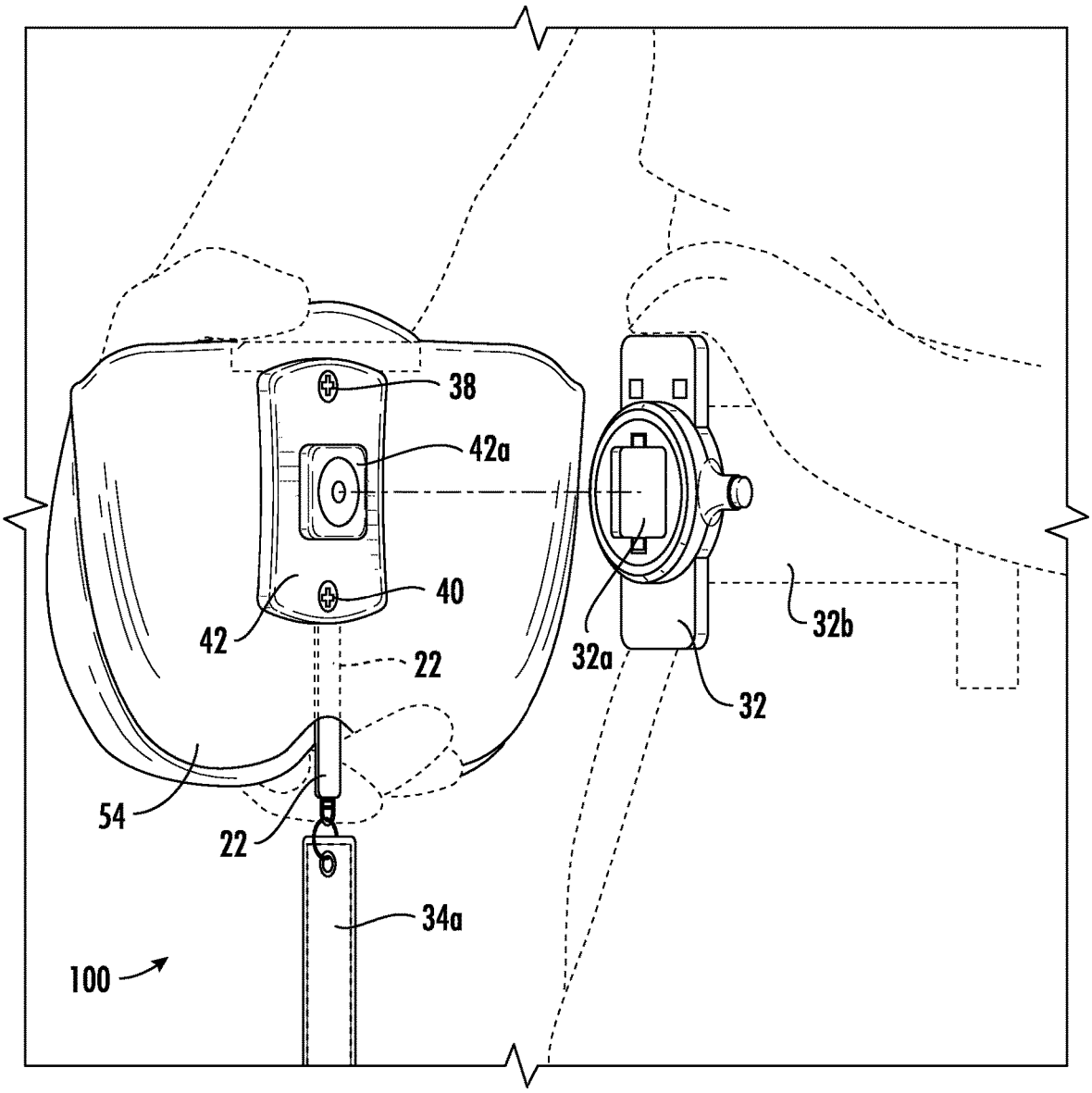
FIG. 6A is a perspective view of the case in FIG. 1, shown detached from a mateable mounting structure worn around a waistband.
Figure 6B:
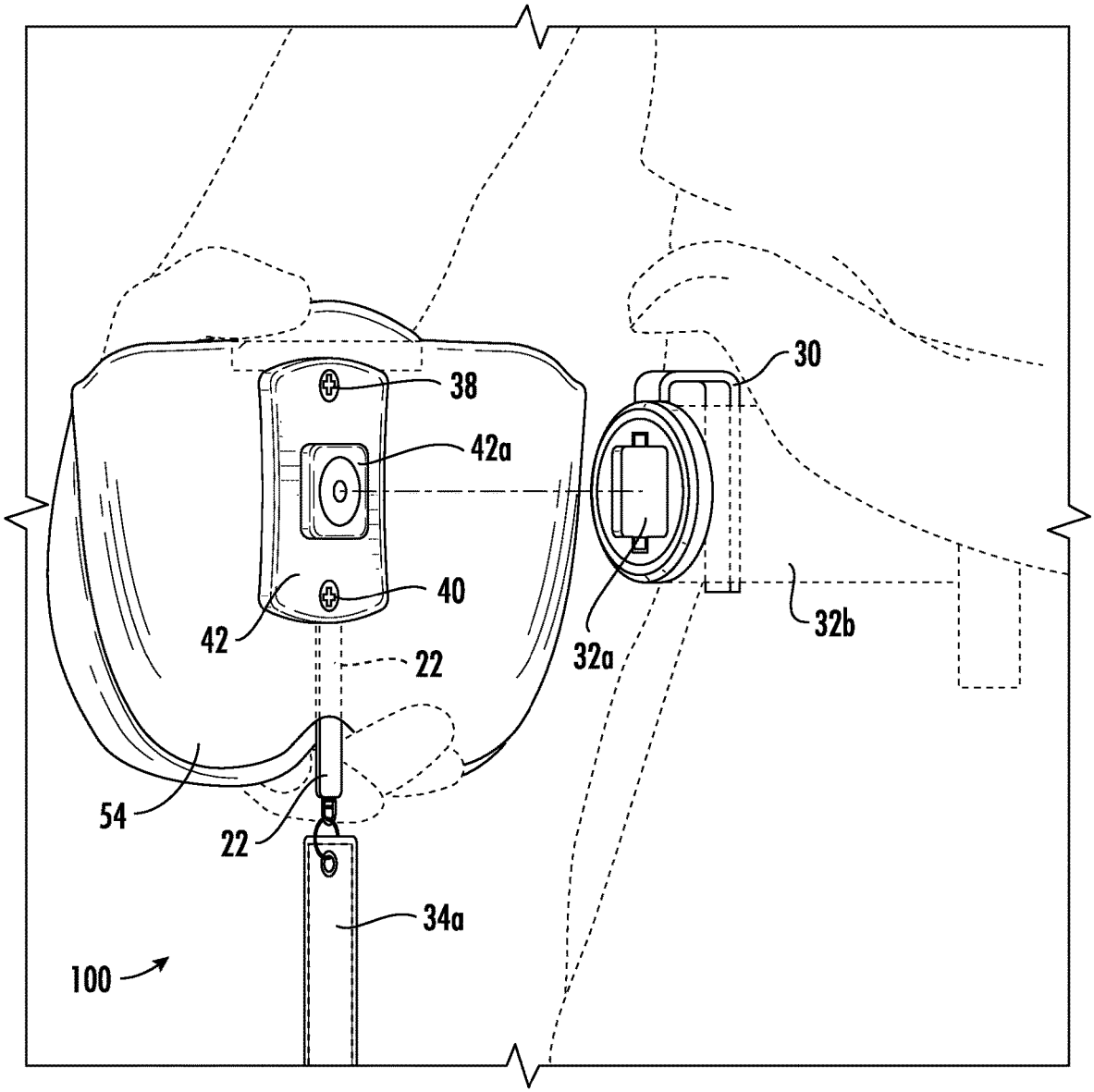
FIG. 6B is a perspective view of a handle embodiment of a mateable mounting structure with the case.
Figure 7:
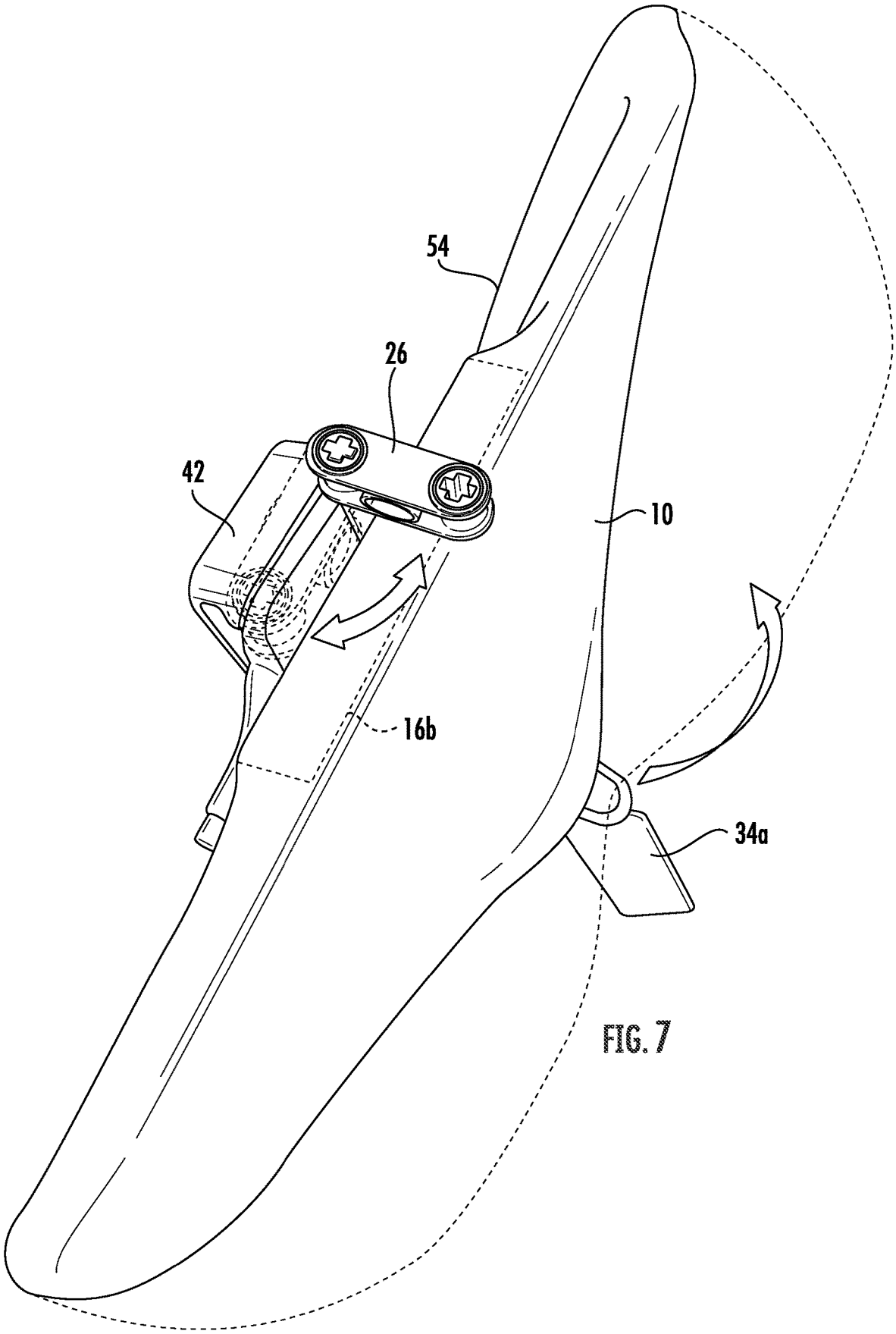
FIG. 7 is a perspective view of the case in FIG. 1, shown in an embodiment where a cover of the case has a semi-open and fully open position by way of a pivoting latch.

The first and second mating members 42*a* 32*a* can be any physical coupling structures such as hook and loop tape, magnets, male-female couplers, and any other coupling structures that when coupled, are secure, and yet allow for convenient and fast decoupling when desired, and are not easily decoupled when the quick release mechanism 34 is engaged. FIGS. 4 and 6A-B show pairs of pressure-fitting members as example embodiments of the first and second mating members 42*a* 32*a* and is not meant to limit the mating members 42*a* 32*a* to the structures shown. One useful embodiment is to affixed the second mating member 32*a* and second mounting bracket 32 to a handle 30 that when coupled with the first mating member 32*a* creates a hand held embodiment of the case 100 that can be conveniently held in the user's hand or positioned on a waistband as shown in FIG. 6B, or affixed directly to an armband/waistband 32*b* as shown in FIG. 6A without the handle 30, allowing the case 100 to be conveniently and directly detachably affixed to a waistband or armband. Note that the handle 30 could also be configured to be permanently affixed to the body 52, and thus the handle is the first mating member, and when hung onto a waistband or belt of a pair of pants, or the handle inserted into a pocket so as to have the case 100 positioned along an exterior side of the pocket, the belt, waistband, pocket, etc. is the second mating member. Hence the term "first mating member" includes a permanently affixed handle or other coupling structure affixed to the case 100 and the term "second mating member" includes a separate waistband or armband, or an existing waistband or pocket for a pair of pants or a shirt worn by the user. The handle 30 is ideally a hook-like structure with an open end and an attachment point to the case 100 where the handle grasping area is held in spaced apart relationship with the back 54 of the case 100 so as to create a channel, and the handle 30 removably couples to the second mating member i.e. a belt or waistband, for instance, by positioning the second mating member into the channel. Note that brackets 42 32 are explicitly described in the embodiments shown in the Figures, however the brackets are also optional, and the inventor notes that the mating members 42*a* 32*a* themselves may be configured such that the supporting mounting brackets 42 32 are unnecessary, including increasing an overall size of the mating members 42*a* 32*a* to provide necessary physical support for the case 100.

Since the body 52 is soft and non-supportive, and the configuration of the release mechanism 34 requires the pull cord release 34*a* to be pulled downwards, the case 100 must be securely affixed to something to resist the downward force of the pull cord release 34*a* and at the same time not grasp or hold the body 52 of the case 100. The case 100 is not designed to withstand crushing, but rather to protect the lens area from scratches and debris and thus to open and close the case 100 it must be mounted to something to prevent the user from grasping the body 52. Mounting options include specific structures for mounting to a wall bracket, handlebars, backpacks, etc., or to a variety of universal mounts and clips for use around a body part or positioned on another structure, or positioned on universal straps, etc. Again, the mounting options can include a permanently affixed handle 30 or other structure that allows the case 100 to be conveniently hung into a loop or over a belt, waistband, etc. Note that the term "universal" here refers to common, standardized prior art coupling systems comprised of a pair of mating members commonly used, and include hook and loop fasteners, quick release side buckles, button and hole structures, snaps, etc. "Universal straps" refers to common, standardized prior art straps typically fitted with a prior art coupling system to allow a variety of items to be removably coupled thereto. These examples are provided to show the versatility of mounting options to position the case 100 in a use position. The inventor notes that so long as the mounting method secures the case 100 so that the release mechanism 34 can be engaged and disengaged without damage to the goggles 44, it is an acceptable method within the scope of this invention. The inventor notes that the detachable nature of the mating members 42*a* 32*a* allows for a variety of storage options but all of which position the case 100 is a specific use position and encourage such behavior since the case 100 cannot be opened or closed otherwise. The user might attach the case 100 to a wall mounted bracket for general storage purposes, for instance, and then detach it and then reattach it to a waistband or simply to the handle 30 when it is race day, allowing the user a variety of ways to hold, store, and make the stowed goggles most conveniently accessible according to need. The decoupling aspect of the invention also encourages the user to put the case 100 in a specific location (i.e., affixed to a structure bearing the second mating member 32*a*) and thus helps the user organize and quickly locate the stored goggles. As the body 52 is a soft fabric, the handle 30 allows for easy opening/closing of the case 100 when the case 100 is not otherwise mounted to a belt, armband, wall, table, or bike handlebars and allows the case 100 to be easily picked up and held in use position. This allows a support person to hold the case 100 in one hand and pull the cord and pull out the clean goggles with a second hand.

Figure 8:
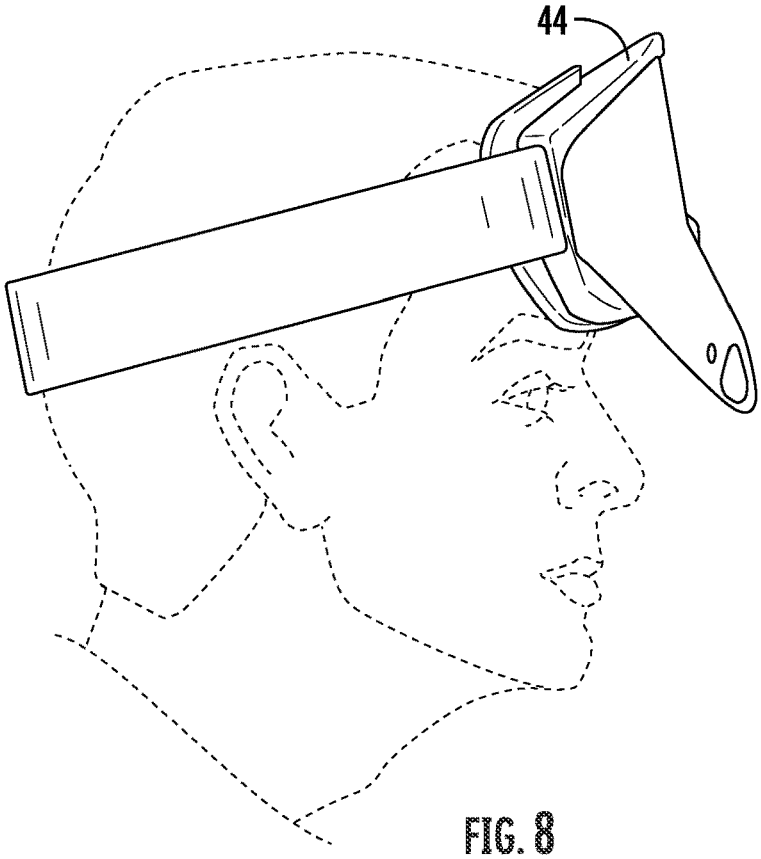
FIG. 8 PRIOR ART
FIGS. 8-9 are prior art methods and structures used to store safety goggles as currently used in the sport of moto-cross.
Figure 9:
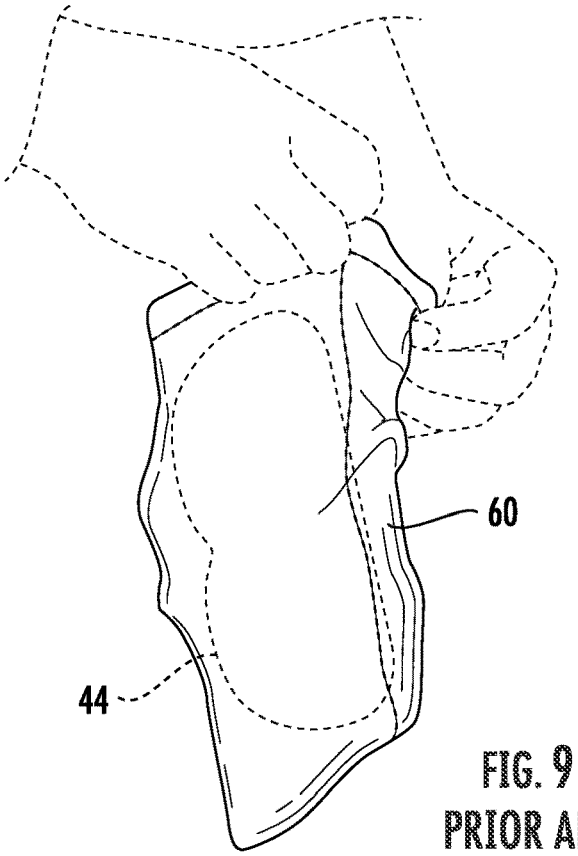
FIG. 9 PRIOR ART
Figure 10:
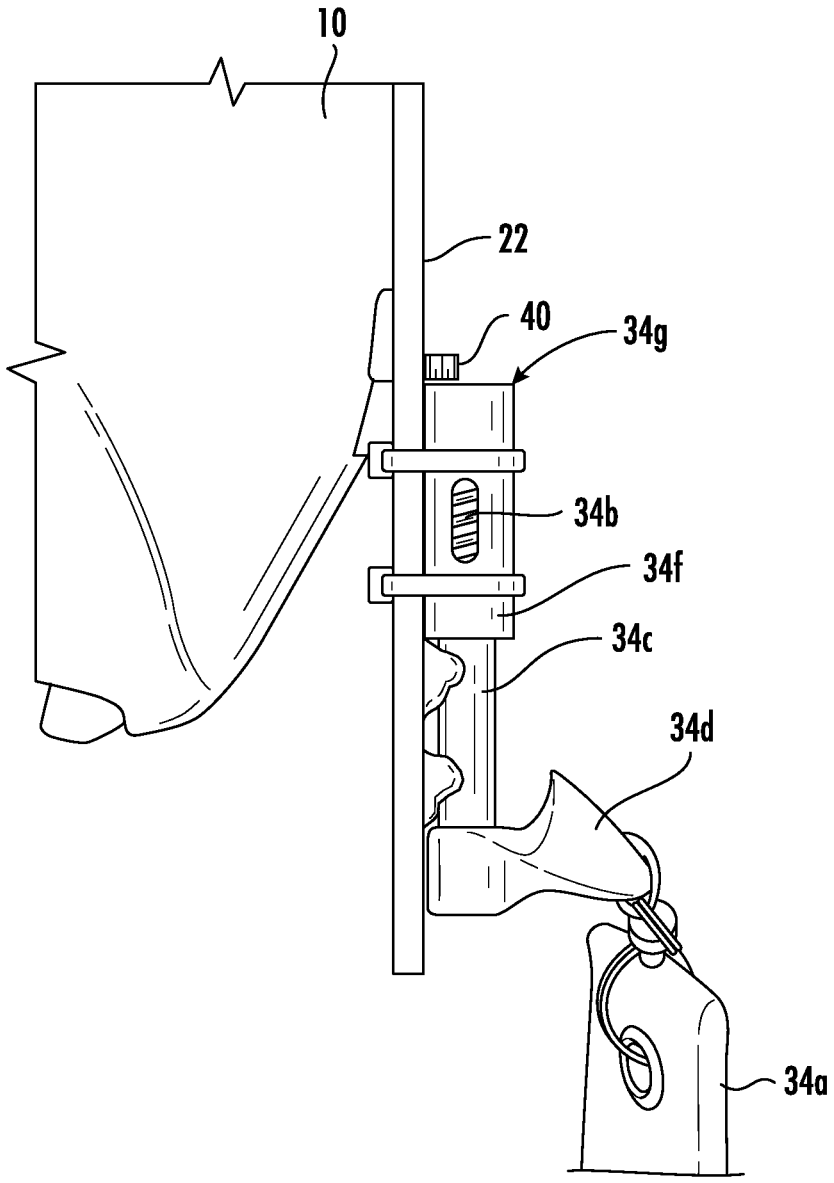
FIG. 10 is a side detail view of a release mechanism of the case.

FIGS. 8-9 show two common prior art methods of storing individual pairs of goggles 44, including simply wearing the goggles on top of a hat or on a head, or more commonly, inside a soft drawstring bag 60. The problem with the prior art methods and structures is that wearing goggles on top of one's head fails to protect the goggles from debris and dust and storing the goggles inside a case keeps the goggles clean, but the act of reaching inside the goggle creates unwanted fingerprints all over the viewing area 44*a* of the goggles, is time consuming, and often introduces dirt and dust into the storage bag. Goggles are also not easily stored prior to use with the prior art drawstring bag 60, where the user's options are limited to holding the soft bag 60 itself, or more commonly, looping the drawstrings around the user's wrist, and then fumbling with the bag with both hands when it is time to remove the goggles. The inventor notes that motocross is a particularly dusty, dirty sport and keeping multiple pairs of goggles clean and ready to quickly swap out during a competition is a key activity for a racer's support team. The quick release case 100 allows for single handed access to the clean, stored goggles, and the V-shaped access 50 limits unwanted fingerprints on the lens area 44*a* of the pair of goggles 44. The open to load hinge 16 quickly flicks the cover 10 open, thereby ensuring any dust/debris on an exterior of the cover does not fall inside the body 52, and the semi-open position allows the user to partially shield the stored pair of goggles 44 from water or other debris in particularly dirty, wet, or dusty conditions by the cover serving as an umbrella for the pair of goggles 44 stored inside the body 52. Debris is also prevented from interfering with the hinge due to its internal location.

It is to be understood that the above-described arrangements are only illustrative of the application of the principles of the present invention. Numerous modifications and alternative arrangements may be devised by those skilled in the art without departing from the scope of the present invention. For instance, the inventor believes the case 100 has applications for emergency situations, where quick or one handed retrieval of goggles are needed, such as for first responders, laboratory, or hospital settings, as well to maintain dust free storage with fast retrieval. The coupling point 14 and the hook 34*d* could easily be replaced with a push-button mechanism and eliminate the pull cord 34*a*, although the inventor believes the pull cord is superior mechanically because it does not require visualization of the button or release location and the user, for instance with the case 100 strapped to a waistband, can easily reach under the case 100 and find the pull cord 34*a* without looking down at the case 100. A lever, handle or push button attached to the hook 34*d* is another alternative to the pull cord that would allow for easy opening of the cover 10. The spring stop 40, currently configured as a screw protruding above the upper end of the post 34*c* and its wire spring 34*b* could easily be replaced by a flange formed into the vertical leg 22 or also by the tube 34*f* simply having an enclosed upper end against which the wire spring 34*b* is positioned in its untensioned or resting state. The case body 52 lacking an internal frame except for the T-shaped frame 18 means less material is needed to construct the case 100, and by consequence, less weight and space when empty cases are stored. Prior art hard shell cases, such as the classic clamshell case for eyeglasses, are not adjustable to accommodate different sized goggles, and since goggles are typically much larger than eyeglasses, a hard clamshell case would be relatively large and perhaps difficult to handle due to its bulky size, and is likely the reason why the soft, drawstring bag 60 is still the industry standard carrying/storage case for goggles. The soft, four-way stretch material used for the present invention and the adjustable frame arm 12*a* provides the lightweight convenience of a drawstring bag 60 but with a structured storage and the superior accessibility afforded by a clamshell case. Neither the clamshell nor the drawstring bag provides the user the ease of using a single hand to open and then access the goggles stored within, a problem elegantly solved by the case 100 of the present invention.

I claim:

1. A case for storing a pair of safety goggles having a lens area and a bridge, the case comprising:

a fabric case having a body and a cover;

wherein the body is comprised of a back side and a front side, the front side further comprised of a center access opening so as to create a pair of opposed front side walls in spaced apart relationship and a goggle-receiving space between the front side and the back side;

wherein the cover has an interior facing side and an exterior facing side;

an internal frame positioned inside the goggle-receiving space and adjacent the interior facing side of the cover;

a release mechanism attached to the internal frame; and a first mating member attached to the internal frame and adapted to removably mate with a second mating member;

wherein the body is sized and shaped to receive the pair of safety goggles and the cover is sized and shaped to hingeably cover the body;

wherein the internal frame is further comprised of a T-shaped frame and a lens-shaped cover frame pivotably affixed to the T-shaped frame;

wherein the T-shaped frame is further comprised of an open to load hinge having an upper leaf and a lower leaf, and a vertical leg having a proximal end, an opposed distal end and a length between the proximal and distal ends, the proximal end of the vertical leg affixed to the lower leaf;

wherein the cover frame is further comprised of a coupling point centrally positioned along the cover frame and sized and shaped to engage the release mechanism; and wherein the release mechanism is further comprised of a hook adapted to slideably disengage the coupling point.

2. The case in claim 1, wherein the fabric case is comprised of four-way stretch material.

3. The case in claim 1, wherein the fabric case is removably secured to at least one of the cover frame and the T-shaped frame.

4. The case in claim 3, wherein the body is further formed with an access hole by which the body is removably secured to at least one of the vertical leg and the first mating member.

5. The case in claim 1, wherein the cover frame is comprised of a wire-like flexible metal, plastic or other suitable material sized and shaped to mimic and maintain a size and shape of the lens area and the coupling point when the fabric case stretches to accommodate the pair of safety goggles stored inside the body with the cover secured thereto.

6. The case in claim 1, further comprising a cover latch having a fixed end and a moving end, the fixed end positioned adjacent the hinge and the moving end pivotably positionable to be at least one of perpendicular to or parallel with the upper leaf, whereby positioning the cover latch perpendicular to the upper leaf positions the cover is a semi-open position by stopping the movement of the upper leaf, and positioning the cover latch parallel to the upper leaf positions the cover in a fully-open position.

7. The case in claim 1, wherein the cover frame is further comprised of a frame arm affixed to the upper leaf, the frame arm having a telescopically adjustable length.

8. The case in claim 1, wherein the cover frame is further comprised of a pair of opposed arm ends in spaced apart relationship and the upper leaf is further comprised of a pair of opposed arm receivers, the arm receivers sized and shaped to receive the pair of opposed arm ends, whereby the cover frame is removably affixed to the upper leaf.

9. The case in claim 1, wherein the release mechanism is further comprised of a post, and wherein the hook is affixed to the post such that both hook and post are in slideable relationship with the length of the vertical leg.

10. The case in claim 9, wherein the release mechanism is further comprised of a tube with which the post is in telescoping relationship, the tube being affixed to the vertical leg and the post slideably positioned inside the tube.

11. The case in claim 10, wherein the release mechanism is further comprised of a wire spring and the post is further comprised of an upper end and lower end, wherein the wire spring is affixed to the upper end and the hook is affixed to the lower end of the post.

12. The case in claim 11, wherein the release mechanism is further comprised of a spring stop positioned at an uppermost end of the post and protruding from the vertical leg whereby vertical movement of the post along the length of the vertical leg is limited by the spring stop.

13. The case in claim 12, wherein the release mechanism is further comprised of a pull cord affixed to at least one of the post and the hook.

14. The case in claim 1, wherein the second mating member is affixed to at least one of a handle, waistband, armband, handle bar, table, clip, pop-up tent leg and wall mount.

15. The case in claim 1, wherein the second mating member is at least one of a universal clip, strap or mount, wherein the universal clip, strap or mount is comprised of a standardized mating structure coupling with the first mating member.

16. The case in claim 1, wherein the first mating member and the second mating member are comprised of at least one of hook and loop closures, side release clips, and male-female couplers.

17. The case in claim 1, wherein the first mating member is a handle with a hook-like structure having a grasping surface held in spaced apart relationship with the back side of the body, whereby a receiving channel is formed between the back side and the grasping surface, and the second mating member is sized and shaped to slideably receive the grasping surface of the hook-like structure by positioning the second mating member inside the channel and between the back side of the body and the grasping surface of the hook-like structure.

18. The case in claim 1, wherein the access opening in the front side is a V-shaped opening and with the vertical member positioned centrally within the opening with its distal end protruding beyond the goggle-receiving space so as to position the hook below the body.

19. The case in claim 1, further comprising a pocket affixed to the vertical leg, the pocket sized and shaped to hold a desiccant bag.

* * * * *